US008212799B2

(12) United States Patent
Kerwin

(10) Patent No.: US 8,212,799 B2
(45) Date of Patent: Jul. 3, 2012

(54) APPARATUS AND METHOD FOR PERFORMING RESPONSE TIME COMPENSATION OF A DISPLAY BETWEEN GRAY LEVEL TRANSITIONS

(75) Inventor: Jonathan Kerwin, San Jose, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 1060 days.

(21) Appl. No.: 11/523,133

(22) Filed: Sep. 18, 2006

(65) Prior Publication Data

US 2008/0068318 A1 Mar. 20, 2008

(51) Int. Cl.
*G09G 5/00* (2006.01)
*G09G 3/36* (2006.01)

(52) U.S. Cl. ..... 345/208; 345/94

(58) Field of Classification Search ..... 345/87–107, 345/208

See application file for complete search history.

(56) References Cited

U.S. PATENT DOCUMENTS

| | | | | |
|---|---|---|---|---|
| 5,465,102 | A | 11/1995 | Usui et al. | |
| 7,034,786 | B2 * | 4/2006 | Ham | 345/89 |
| 7,038,647 | B2 * | 5/2006 | Shigeta et al. | 345/89 |
| 7,095,393 | B2 * | 8/2006 | Lee | 345/89 |
| 7,106,287 | B2 * | 9/2006 | Ham | 345/89 |
| 7,148,869 | B2 * | 12/2006 | Chen et al. | 345/89 |
| 7,154,467 | B2 * | 12/2006 | Kojima et al. | 345/89 |
| 7,190,340 | B2 * | 3/2007 | Sugino | 345/89 |
| 7,248,241 | B2 * | 7/2007 | Chen et al. | 345/89 |
| 7,248,242 | B2 * | 7/2007 | Chen et al. | 345/89 |
| 7,362,296 | B2 * | 4/2008 | Song et al. | 345/94 |
| 2002/0024481 | A1 * | 2/2002 | Kawabe et al. | 345/87 |
| 2003/0098839 | A1 * | 5/2003 | Lee | 345/89 |
| 2004/0027322 | A1 * | 2/2004 | Chen et al. | 345/89 |
| 2004/0041767 | A1 * | 3/2004 | Sugino | 345/89 |
| 2004/0196274 | A1 * | 10/2004 | Song et al. | 345/204 |
| 2005/0062703 | A1 * | 3/2005 | Lee et al. | 345/89 |
| 2005/0068343 | A1 * | 3/2005 | Pan et al. | 345/690 |
| 2006/0022926 | A1 * | 2/2006 | Mizumaki et al. | 345/89 |
| 2006/0050038 | A1 * | 3/2006 | Cheon et al. | 345/89 |
| 2006/0158416 | A1 * | 7/2006 | Ku | 345/98 |
| 2007/0075951 | A1 * | 4/2007 | Lin et al. | 345/89 |

FOREIGN PATENT DOCUMENTS

| | | | |
|---|---|---|---|
| JP | 2003-36055 | A | 2/2003 |
| KR | 10-2001-0077568 | A | 8/2001 |
| KR | 10-2004-0087426 | A | 10/2004 |

* cited by examiner

*Primary Examiner* — Adam J Snyder
(74) *Attorney, Agent, or Firm* — Wade J. Brady, III; Frederick J. Telecky, Jr.

(57) ABSTRACT

An apparatus and method for performing response time compensation. The apparatus described includes a first response time compensation (RTC) module for providing boosted gray level values when transitioning only from a previous gray level of zero to a first current gray level for a color of a pixel of a display. The apparatus also includes a second RTC module for providing boosted gray level values when transitioning from a previous gray level greater than zero to a current gray level for the color of the pixel.

19 Claims, 8 Drawing Sheets

600

615 617

| CGL | PGL | | | | | | | | | | | | | | | | | |
|---|---|---|---|---|---|---|---|---|---|---|---|---|---|---|---|---|---|---|
| | 0 | 0' | 16 | 32 | 48 | 64 | 80 | 96 | 112 | 128 | 144 | 160 | 176 | 192 | 208 | 224 | 240 | 256 |
| 0 | 0 | 0 | 0 | 0 | 0 | 0 | 0 | 0 | 0 | 0 | 0 | 0 | 0 | 0 | 0 | 0 | 0 | 0 |
| 16 | 45 | 32 | 16 | 5 | 3 | 1 | 0 | 0 | 0 | 0 | 0 | 0 | 0 | 0 | 0 | 0 | 0 | 0 |
| 32 | 110 | 49 | 41 | 32 | 20 | 16 | 14 | 11 | 6 | 1 | 0 | 0 | 0 | 0 | 0 | 0 | 0 | 0 |
| 48 | 138 | 82 | 71 | 59 | 48 | 36 | 31 | 27 | 22 | 17 | 11 | 6 | 3 | 0 | 0 | 0 | 0 | 0 |
| 64 | 153 | 95 | 86 | 82 | 74 | 64 | 58 | 47 | 43 | 31 | 24 | 18 | 9 | 4 | 1 | 0 | 0 | 0 |
| 80 | 165 | 114 | 103 | 97 | 95 | 92 | 80 | 73 | 67 | 51 | 41 | 35 | 24 | 20 | 8 | 6 | 3 | 0 |
| 96 | 176 | 145 | 133 | 127 | 121 | 117 | 107 | 96 | 85 | 74 | 66 | 57 | 47 | 42 | 25 | 12 | 5 | 0 |
| 112 | 185 | 161 | 149 | 148 | 146 | 142 | 135 | 121 | 112 | 100 | 95 | 66 | 69 | 57 | 43 | 25 | 12 | 2 |
| 128 | 193 | 188 | 174 | 173 | 171 | 166 | 154 | 148 | 137 | 128 | 117 | 112 | 101 | 89 | 71 | 54 | 26 | 8 |
| 144 | 213 | 209 | 204 | 198 | 196 | 192 | 186 | 177 | 166 | 161 | 144 | 133 | 124 | 111 | 97 | 75 | 48 | 15 |
| 160 | 235 | 230 | 227 | 224 | 221 | 223 | 209 | 203 | 197 | 192 | 175 | 160 | 152 | 138 | 121 | 106 | 75 | 33 |
| 176 | 248 | 242 | 240 | 238 | 236 | 230 | 222 | 226 | 220 | 216 | 207 | 190 | 176 | 168 | 144 | 126 | 92 | 47 |
| 192 | 255 | 255 | 255 | 255 | 242 | 240 | 241 | 240 | 242 | 238 | 235 | 227 | 205 | 192 | 176 | 154 | 117 | 67 |
| 208 | 255 | 255 | 255 | 255 | 255 | 255 | 255 | 255 | 253 | 246 | 237 | 237 | 227 | 225 | 208 | 181 | 138 | 81 |
| 224 | 255 | 255 | 255 | 255 | 255 | 255 | 255 | 255 | 255 | 255 | 255 | 254 | 251 | 246 | 233 | 224 | 177 | 114 |
| 240 | 255 | 255 | 255 | 255 | 255 | 255 | 255 | 255 | 255 | 255 | 255 | 255 | 255 | 255 | 255 | 249 | 240 | 165 |
| 256 | 256 | 256 | 256 | 256 | 256 | 256 | 256 | 256 | 256 | 256 | 256 | 256 | 256 | 256 | 256 | 256 | 256 | 256 |

630

640 610 620

Fig. 6

APPARATUS AND METHOD FOR PERFORMING RESPONSE TIME COMPENSATION OF A DISPLAY BETWEEN GRAY LEVEL TRANSITIONS

BACKGROUND OF THE INVENTION

1. Field of the Invention

Embodiments of the present invention relate to the field of response time compensation. More particularly, embodiments of the present invention relate generally to the transitions from gray level zero for response time compensation.

2. Related Art

Active-matrix liquid crystal display (LCD) technology is becoming important to the television market. Television imposes a new challenge on the current LCD technology, such as presenting faster response times between gray levels.

LCDs are progressively scanned. That is, at every instant there is a partial frame of both the old and new frame visible on the display with a progressively moving tear boundary through the display. This scan-and-hold aspect of the LCD is nearly ideal for the presentation of static images, such as computer-generated spreadsheets and word documents.

However, the scan-and-hold aspect of the LCD is undesirable from the standpoint of video applications. That is, the response times of LCDs are inadequate to show high quality video.

Response time compensation (RTC) is one solution to improve the response time of an LCD panel between gray level transitions. Without RTC, the long transition times between gray levels produce blurry images when video is displayed on the LCD panel. This negatively results in blurry video for transitions starting from black pixels, and decreases the overall average response time of the LCD panel.

SUMMARY OF THE INVENTION

Accordingly, various embodiments of the present invention disclose an apparatus and method for enhancing transitions between gray levels for response time compensation. Embodiments of the present invention provide the above accomplishments and further provide for improved handling of transitions from gray level zero for response time compensation. Still other embodiments provide for the above accomplishments and further provide for sharper response times for video starting from black pixels, and as a result, improves the overall average response time of the corresponding LCD display.

Specifically, in one embodiment an apparatus is described and comprises a first response time compensation (RTC) module that provides boosted gray level values when transitioning only from a previous gray level of zero to a first current gray level for a color of a pixel of a display. The apparatus also comprises a second RTC module that provides boosted gray level values when transitioning from a previous gray level greater than zero to a current gray level for the color of the pixel.

In another embodiment, a method is described for performing response time compensation. The present embodiment determines a previous gray level of a color for a pixel of a display. The present embodiment also determines a current gray level of a pixel of a display. Then, the present embodiment determines a boosted gray level from an RTC surface that provides boosted gray level values when transitioning only from a previous gray level of zero.

BRIEF DESCRIPTION OF THE DRAWINGS

FIG. 6 shows a table illustrating enhanced zero-handling of RTC LUT values, in accordance with one embodiment of the present invention.

DETAILED DESCRIPTION OF THE INVENTION

Figure 1:
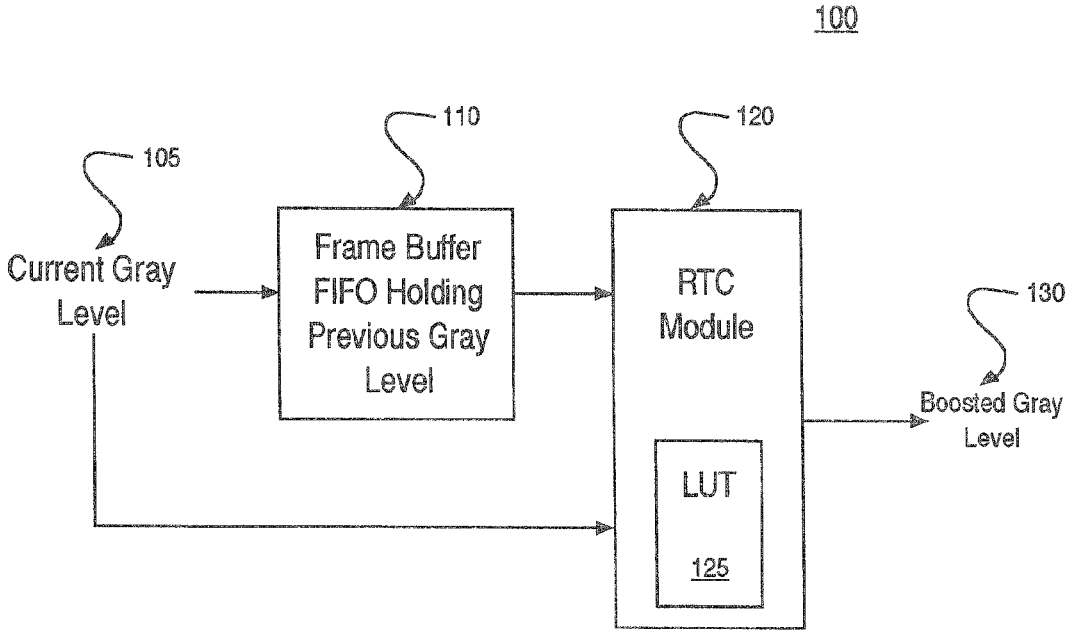
FIG. 1 is a block diagram of a system capable of performing RTC, in accordance with one embodiment of the presently claimed invention.

Reference will now be made in detail to the preferred embodiments of the present invention, an apparatus and method for performing response time compensation, examples of which are illustrated in the accompanying drawings.

Accordingly, various embodiments of the present invention disclose an apparatus and method for enhancing transitions between gray levels for response time compensation. Embodiments of the present invention provide the above accomplishments and further provide for improved handling of transitions from gray level zero for response time compensation. Still other embodiments provide for the above accomplishments and further provide for sharper response times for video starting from black pixels, and as a result, improves the overall average response time of the corresponding LCD display.

The following detailed description is of example embodiments of the presently claimed invention with references to the accompanying drawings. Such description is intended to be illustrative and not limiting with respect to the scope of the present invention. Such embodiments are described in sufficient detail to enable one of ordinary skill in the art to practice the subject invention, and it will be understood that other embodiments may be practiced with some variations without departing from the spirit or scope of the subject invention.

Notation and Nomenclature

Embodiments of the present invention can be implemented on hardware or software running on a computer system in conjunction with an imaging system, such as an LCD display (e.g., television display). The computer system can be a personal computer, notebook computer, server computer, mainframe, networked computer, workstation, and the like. This software program is operable for providing response time compensation. In one embodiment, the computer system includes a processor coupled to a bus and memory storage coupled to the bus. The memory storage can be volatile or non-volatile and can include removable storage media. The computer can also include a display, provision for data input and output, etc.

Some portions of the detailed descriptions which follow are presented in terms of procedures, steps, logic blocks, processing, and other symbolic representations of operations on data bits that can be performed on computer memory. These descriptions and representations are the means used by those skilled in the data processing arts to most effectively convey the substance of their work to others skilled in the art. A procedure, computer executed step, logic block, process, etc., is here, and generally, conceived to be a self-consistent sequence of operations or instructions leading to a desired result. The operations are those requiring physical manipulations of physical quantities. Usually, though not necessarily, these quantities take the form of electrical or magnetic signals capable of being stored, transferred, combined, compared, and otherwise manipulated in a computer system. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present invention, discussions utilizing terms such as "determining," "accessing, "performing," or the like, refer to the actions and processes of a computer system, or similar electronic computing device, including an embedded system, that manipulates and transforms data represented as physical (electronic) quantities within the computer system's registers and memories into other data similarly represented as physical quantities within the computer system memories or registers or other such information storage, transmission or display devices.

Response Time Compensation

FIG. 1 is a block diagram of a system 100 capable of performing-response time compensation, in accordance with one embodiment of the present invention. In general, the RTC mechanism intercepts a digital video stream and compares the previous gray level command for each pixel with the current gray level command, and chooses a predetermined alternate gray level from a look-up table (LUT).

Specifically, the system 100 comprises a frame buffer 110. In one embodiment, the frame buffer 110 comprises an external full frame first-in first-out (FIFO) memory. The frame buffer 110 stores a current gray level for a particular color of a pixel of a display for use in the next frame.

The RTC module 120 retrieves the previous gray level from the frame buffer 110. The RTC module 120 also receives the current gray level 105. Thereafter, the RTC module 120 compares the previous gray level and the current gray level 105 for the color of the pixel to determine a boosted gray level 130. The boosted gray level 130 is determined from the contents of the LUT 125. In one embodiment, the RTC module 120 comprises the LUT 125. In another embodiment, the LUT 125 is external to the RTC module 120. The boosted gray level 130 provides a unique gray level surrogate for each pairing possibility of current gray levels to previous gray levels.

Figure 2:
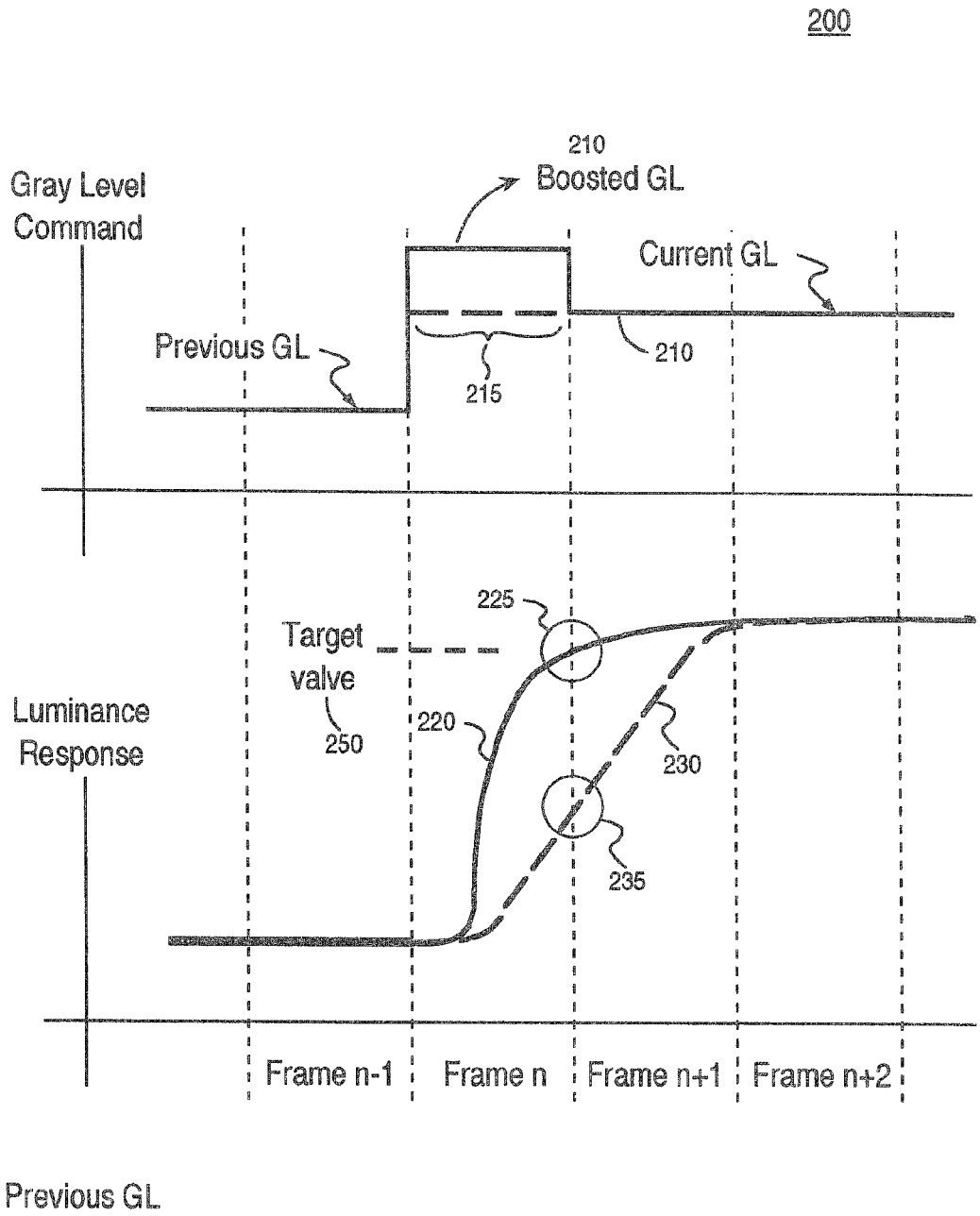
FIG. 2 is a graph illustrating the gray level command issued with and without RTC and the corresponding luminance response of a display, in accordance with one embodiment of the present invention.

FIG. 2 is a graph 200 illustrating the application of RTC, in accordance with one embodiment of the present invention. The top half of graph 200 illustrates the gray level command issued per frame. The bottom half of graph 200 illustrates the luminance response of a color of a pixel of a display corresponding to the gray level command per frame. For purposes of illustration and brevity, graph 200 is shown to describe the RTC process. While graph 200 illustrates the over-boosting applied to the current gray level command when transitioning from a previous gray level to a current gray level of greater value, it is understood that embodiments of the present invention are capable of providing under-boosting of gray levels when transitioning from a previous gray level to a current gray level of lesser value.

As shown in graph 200, the line 210 illustrates the gray level command that is issued per frame for a particular color (e.g., red, green, or blue) of a pixel of a display. In the present embodiment, a transition at Frame n from a previous gray level to a current gray level is shown.

In addition, lines 220 and 230 show the luminance response per frame corresponding to the gray level command per frame. Specifically, line 220 shows the luminance response with RTC, and dotted line 230 shows the luminance response without RTC.

In graph 200, up to Frame n−1 a previous gray level command is issued. The luminance response has stabilized for both the lines 220 and 230 up to Frame n−1.

At Frame n, the transition from the previous gray level command to the current gray level command occurs. Without RTC, at Frame n, the current gray level command is issued, as shown by dotted line 215. Without RTC, the luminance response is poor. The corresponding luminance response, shown by dotted line 230, illustrates that the luminance response without RTC does not meet the target value 250 within one frame. In particular, isolation area 235 shows that the luminance response without RTC of line 230 falls well below the target value 250 at the end of Frame n. Moreover, the luminance response without RTC does not meet or exceed the target value 250 until Frame n+2. This produces poor video quality of the display.

On the other hand, with RTC, at Frame n, a boosted gray level command is issued, as shown by line 210. The boosted gray level command is calculated to overdrive the display by the boosted gray level command to just bring the luminance response to the target value 250 by the end of one frame. As shown by graph 200, with RTC, at Frame n, the corresponding luminance response shown by line 220 reaches the target value 250 within one frame. In particular, isolation area 225 shows that the luminance response with RTC with RTC of line 220 meets the target value 250 at the end of Frame n. This produces improved video quality of the display.

Figure 3:
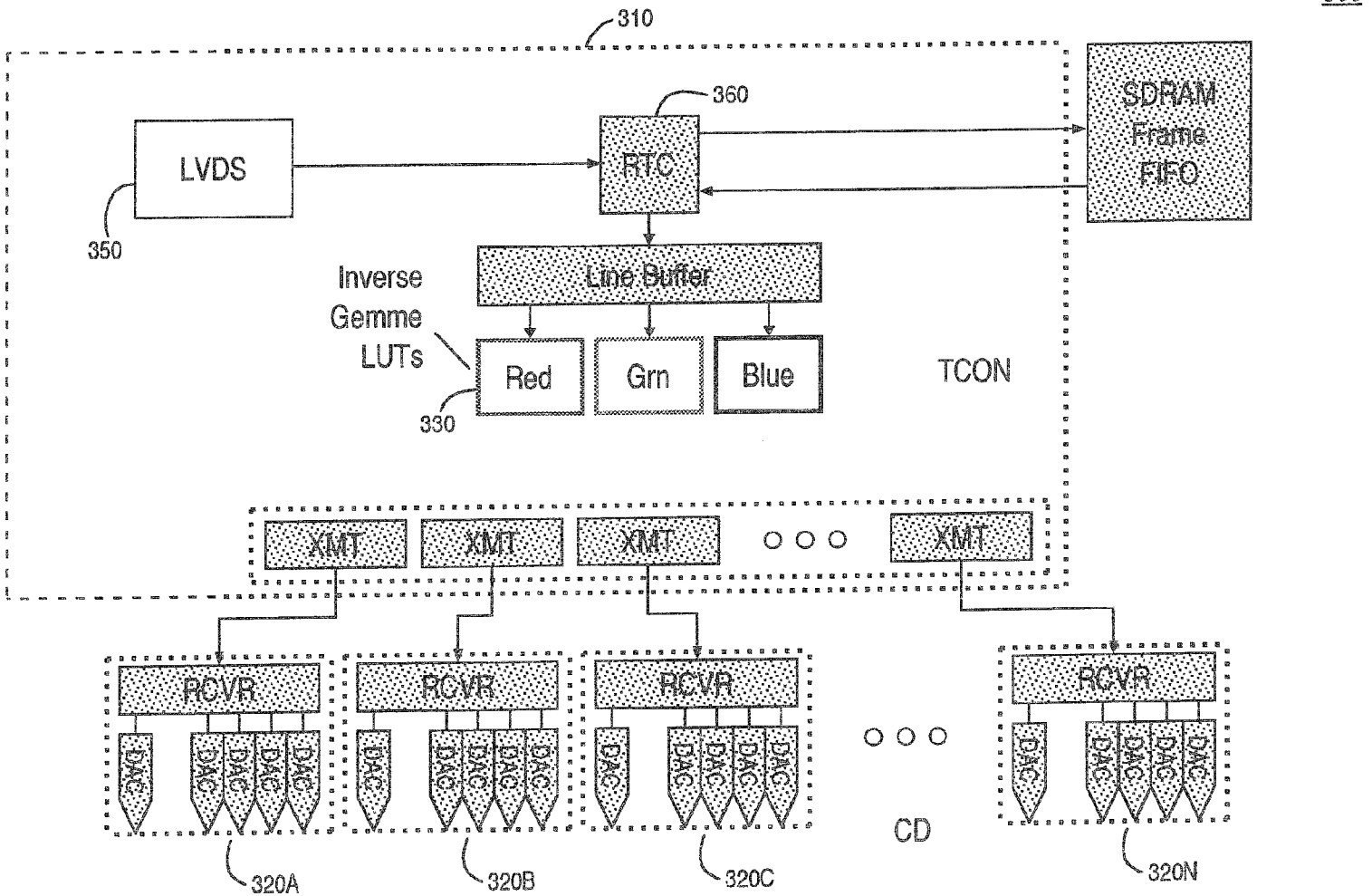
FIG. 3 is a diagram illustrating a timing controller capable of performing RTC, in accordance with one embodiment of the present invention.

FIG. 3 is a diagram illustrating a timing controller capable of performing RTC, in accordance with one embodiment of the present invention.

Some embodiments of the present invention are implemented within a point-to-point differential signaling (PPDS™) system for communication within a television or high-end monitor. FIG. 3 is a exemplary diagram illustrating the PPDS™ architecture 300. The PPDS™ architecture 300 comprises a timing controller 310 and a plurality of column drivers 320A through 320N.

The PPDS™ data signaling architecture 300 provides a single channel, direct point-to-point link between the timing controller 310 and each column driver 320A-N of a display device. In one embodiment, PPDS™ is a system of separate, point-to-point links, wherein a single channel is associated with a column driver. This channel carries column-driver control information and digital voltage values that are converted to into analog by the column driver. In the PPDS™ system, all the column drivers simultaneously receive their data, in one embodiment. As such, even if there is a single differential channel supplying each column driver with data, the channel is used continuously.

The timing controller 310 comprises a RTC module 360, in one embodiment. The RTC module 360 takes the luminance data (e.g., the current gray level command) from the low voltage differential signaling (LVDS) module 350. The luminance data was originally captured from an image source (not shown). As described before, the RTC module accesses at least one LUT to determine the proper gray level command to produce the appropriate luminance response within a particular frame period (e.g., within one frame) when transitioning from a previous gray level to a current gray level, as will be more fully described below in the discussions related to FIGS. 4-8. The output of the RTC module 360 goes to the line buffer and inverse gamma LUTs.

Each of the column drivers 320A-N of FIG. 3 uses a linear, cyclic digital-to-analog converter (DAC), in accordance with one embodiment of the present invention. As such, unlike the conventional R-DAC configurations whose non-linear transfer characteristic is hardwired into a resistor ladder, the DAC of the present invention is linear over its dynamic range. This allows the inverse gamma function to be decoupled from the DAC and placed in the digital LUTS (e.g., the red LUT 330) in the timing controller, upstream from the column driver.

As shown in FIG. 3, the inverse gamma function is decoupled from the DAC circuit, in one embodiment of the present invention. This means that each column driver output directly converts digital voltage values into analog voltage values. The conversion from digital gray levels to digital voltages takes place upstream in the timing controller. In other words, the inverse gamma function is provided in an LUT resident (e.g., red LUT 330) on the timing controller 310. This provides great flexibility in mapping each gray level to brightness on the display device. As such, a separate LUT for each color is possible, in one embodiment. Also, real-time updates to accommodate different image sources, contrast expansion, color management, and temperature changes are possible in embodiments of the present invention.

Transitioning from Gray Level Zero

Figure 4:
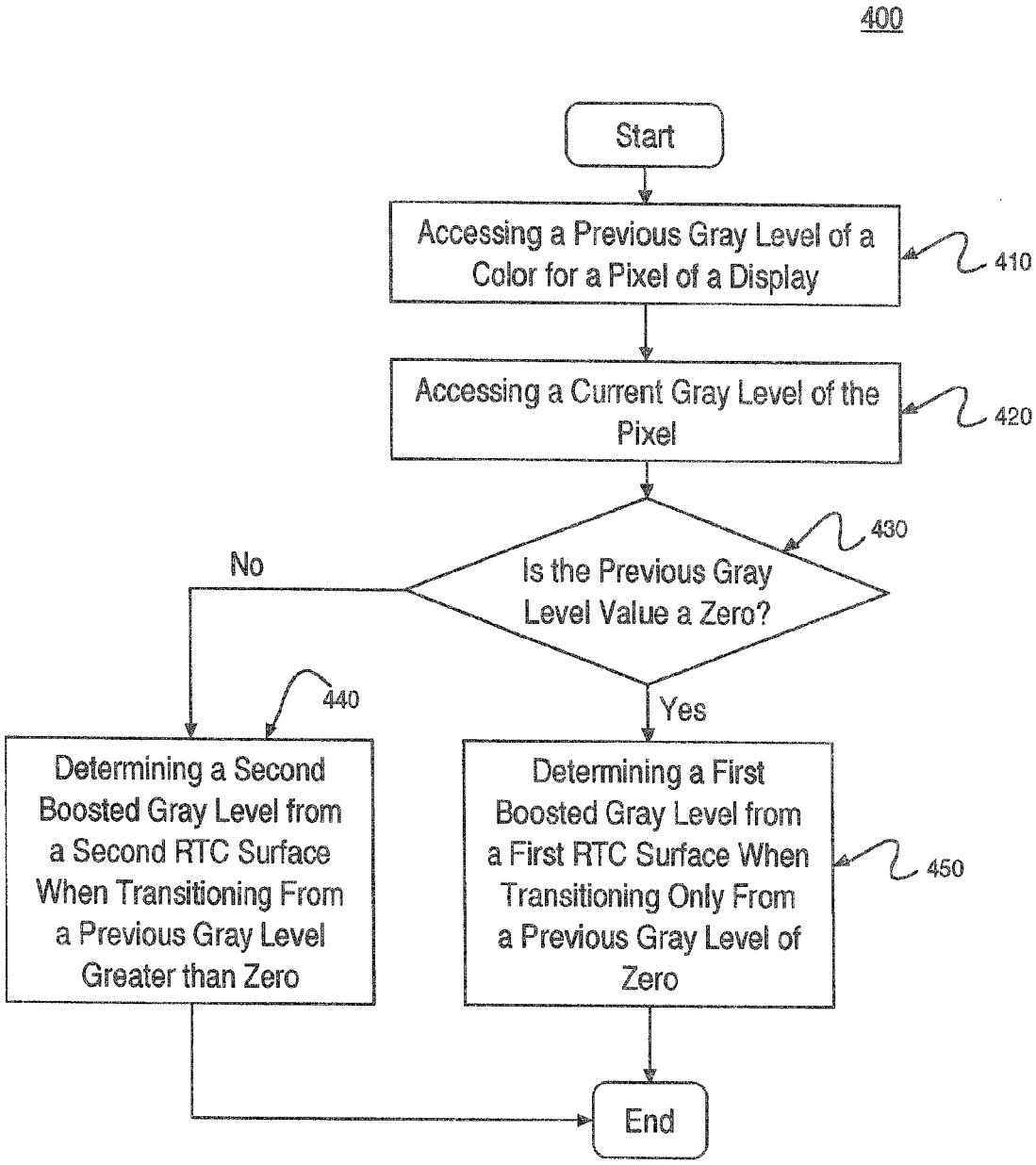
FIG. 4 is a flow diagram 400 illustrating a computer implemented method for performing RTC when transitioning from gray level zero, in accordance with one embodiment of the present invention.

FIG. 4 is a flow diagram 400 illustrating a computer implemented method for performing RTC when transitioning from gray level zero, in accordance with one embodiment of the present invention. As a result, the amount of over-drive boost with RTC is calculated to bring a luminance response of a corresponding color of a pixel of a display to the correct luminance within a predetermined period (e.g., one frame).

At 410, the present embodiment accesses a previous gray level of a pixel of a display. The gray level corresponds to a particular color (e.g., red, green, or blue) of the pixel.

At 420, the present embodiment accesses a current gray level of the pixel. That is, a transition is occurring at a particular frame from the previous gray level to the current gray level. In particular, the current gray level is calculated to produce the appropriate luminance response of the pixel on the display.

At determination step 430, the present embodiment determines if the previous gray level is zero. If the previous gray level is zero, the present embodiment proceeds to 450 to perform RTC. If the previous gray level is greater than zero, the present embodiment proceeds to 440 to perform RTC.

At 450, the present embodiment performs RTC compensation. In particular, the present embodiment determines a first boosted gray level from a first RTC surface that provides a first set of boosted gray level values when transitioning only from a previous gray level of zero. Previously, the present embodiment is capable of determining if the previous gray level is zero.

Specifically, the amount of boost for RTC when transitioning from gray level zero may be significantly higher than when transitioning from a previous gray level that is greater than zero. As such, the present embodiment is capable of generating the appropriate amount of boost for RTC when transitioning from gray level zero.

In one embodiment, the boosted gray level command is determined by performing interpolation on a 1×N LUT that comprises the first RTC surface. That is, the 1×N LUT comprises interpolation values calculated when transitioning between a minimum gray level of zero for the previous gray level to a maximum gray level for current gray levels. More specifically, bi-linear interpolation is performed in one embodiment.

Additionally, at 440 the present embodiment determines a second boosted gray level when transitioning from a previous gray level that is greater than zero. In particular, the second boosted gray level is determined from a second RTC surface that provides boosted gray level values when transitioning from a previous gray level comprising a second value greater than zero. The second RTC surface is capable of providing for over-boosting a gray level command when transitioning from a previous gray level that is greater than zero to a current gray level of greater value. In addition, the second RTC surface is capable of providing for under-boosting a gray level command when transitioning from a previous gray level to a current gray level of lesser value.

In one embodiment, the boosted gray level command is determined by performing interpolation on an N×N LUT comprising the second RTC surface. That is, the N×N LUT comprises interpolation values calculated when transitioning from previous gray levels greater than zero to any value of current gray level. As such, the boosted gray level command may provide for over-boosting when transitioning to a higher gray level, or under-boosting when transitioning to a lower gray level.

Figure 5:
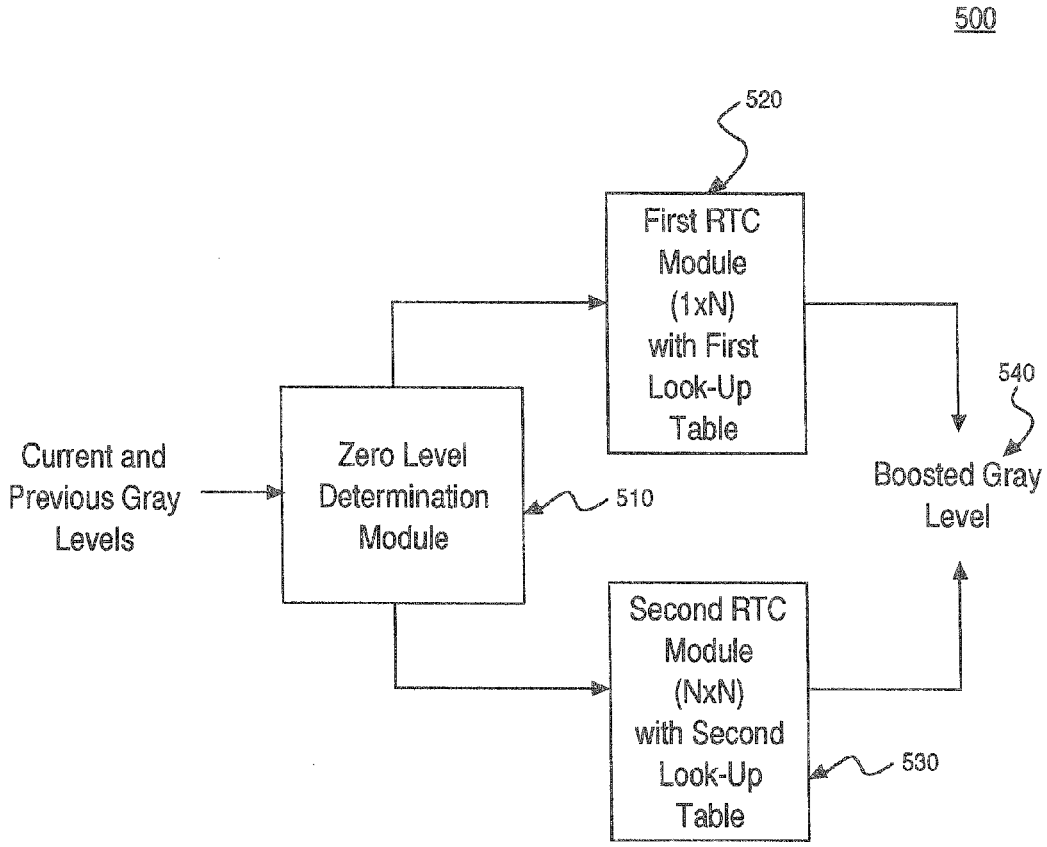
FIG. 5 is a block diagram of a system 500 that is capable of performing RTC when transitioning from a previous gray level of zero, in accordance with one embodiment of the present invention.

FIG. 5 is a block diagram of a system 500 that is capable of performing RTC, in accordance with one embodiment of the present invention. In embodiments, the system 500 is analogous to the RTC module 360 of FIG. 3 and the RTC module of FIG. 1.

The system 500 comprises a zero value determination module 510 that accesses or receives a previous gray level and a current gray level. Specifically, the zero value determination module 510 determines when the previous gray level is zero.

The system 500 comprises a first RTC module 520 for providing boosted gray level values when transitioning only from a previous gray level of zero for a color of a pixel of a display. The boosted gray level value is calculated to generate the appropriate luminance response of the pixel within a particular period (e.g., one frame period, two frame periods, or a fraction thereof, etc.) when transitioning from the previous gray level of zero to a current gray level.

The first RTC module 520 comprises a 1×N LUT providing the boosted gray level command values. In particular, the 1×N LUT comprises a first set of interpolation values calculated between a minimum gray level of zero and a maximum gray level for current gray levels. The interpolation values correspond to a transition from a previous gray level of zero.

Turning now to FIG. 6, a table 600 is shown illustrating enhanced zero-handling of RTC LUT values, in accordance with one embodiment of the present invention. A previous gray level is represented by the row 630. A current gray level is represented by the column 640. Boosted gray levels are obtained by performing interpolation between values in the table 600 for a particular combination of previous gray level and current gray level. The table 600 provides an approximation of a corresponding display panel's response time characteristics.

Table 600 comprises N rows and N+1 columns. In embodiments of the present invention, table 600 represents panel-specific data that will vary between models. For purposes of brevity and clarity, as shown in FIG. 6, N=17 in one embodiment. In addition, the exemplary values provided in table 600 are for purposes of illustration only and are used to illustrate possible boosted RTC values for a particular pixel of a display. It is understood that the values provided in table 600 may be different than provided, in embodiments of the present invention. Further, other embodiments of the present invention are well suited to uneven rows and columns in Table 600, such that there may be N rows and M+1 columns, where N and M are different.

In particular, the first column 610 of table 600 comprises the 1×N LUT that comprises the first set of interpolation values. That is, the 1×N LUT provides major values for the boosted gray level between a minimum gray level of zero and a maximum gray level for the current gray level. As shown in FIG. 6, the maximum gray level in the present embodiment is based on a bit value of 8; however, other embodiments are well suited to maximum gray level values that are based on bit values other than 8.

In one embodiment, linear interpolation is performed to calculate the boosted gray level value for a particular combination of previous gray level and current gray level commands. Linear interpolation requires two entries from the 1×N LUT represented by column 610 (e.g., the values from the closest value below and above the current gray levels), in one embodiment. For example, for a previous gray level of zero, if the current gray level is 94, the major values in the 1×N LUT is found by recognizing that 94 lies between 80 and 96. As shown in FIG. 6, two values are extracted from table 600 to perform linear interpolation. These values are 165 at (0,80); and 176 at (0,96). From these two numbers, performing linear interpolation obtains a singe number that best approximates the value for the original pairing of 0 for the previous gray level and 94 for the current gray level. In one specific embodiment, bi-linear interpolation is performed, using repeated values.

In addition, the 1×N LUT represented by column 610 corresponds to a first RTC surface providing boosted gray level values when transitioning only from the previous gray level of zero to said first current gray level.

Figure 7:
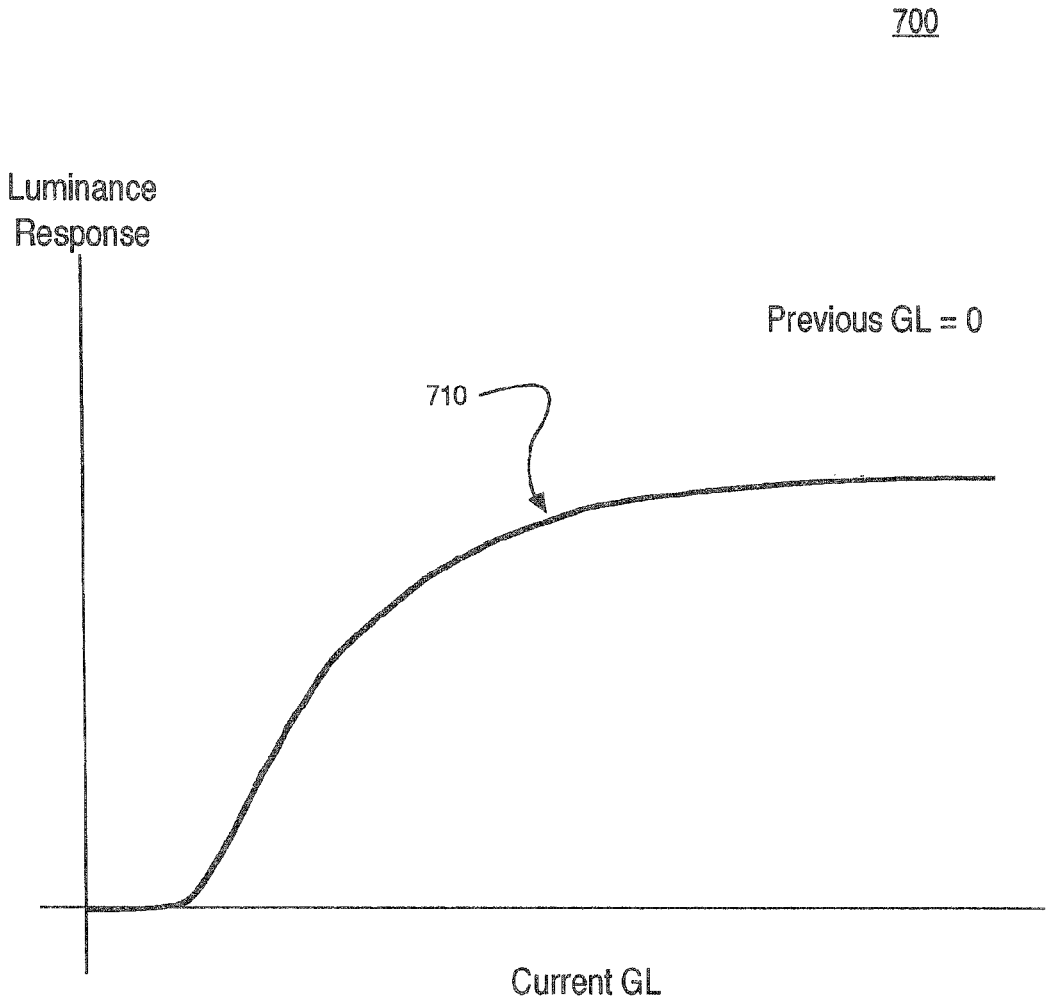
FIG. 7 is a graph illustrating an RTC surface that shows boosted gray level command values corresponding to a current gray level command when transitioning from a previous gray level of zero, in accordance with one embodiment of the present invention.

In one embodiment, FIG. 7 is a graph 700 illustrating the first RTC surface, in accordance with one embodiment of the present invention. As shown in FIG. 7, the first RTC surface is a curve 710 that shows the boosted gray level command values that correspond to a current gray level command when transitioning from a previous gray level of zero. In one embodiment, the graph 700 corresponds to the first column 610 of values in Table 600.

Returning back to FIG. 5, the system 500 also comprises a second RTC module 530 for providing boosted gray level values when transitioning from a previous gray level greater than zero for the color of the pixel. For example, the second RTC module 530 provides for over-boosted gray level values when transitioning from a previous gray level greater than zero to a current gray level that is greater in value. Also, the second RTC module 530 provides for under-boosted gray level values when transitioning from a previous gray level greater than zero to a current gray level that is lesser in value.

As shown in FIG. 5, the second RTC module 520 comprises an N×N LUT providing the boosted gray level command values. In particular, the N×N LUT comprises a second set of interpolation values for determining the boosted gray level command when transitioning from a previous gray level greater than zero to a current gray level.

In particular, in one embodiment, the N×N LUT comprises a second set of interpolation values calculated between a minimum gray level of zero and a maximum gray level for previous gray levels for all values of current gray levels between the minimum and maximum gray level values. The interpolation values correspond to a transition from a previous gray level greater than zero to a current gray level. While the previous gray level is greater than zero, the interpolation values are based on a minimum gray level of zero for purposes of streamlined calculations when performing interpolation, especially since between column 615, representing a previous gray level of 0', and the 617 column, representing a previous gray level of 16, the interval remains at 16.

In another embodiment, the N×N LUT comprises a second set of interpolation values calculated between a minimum gray level greater than zero and a maximum gray level for previous gray levels for all values of current gray levels between the minimum and maximum gray level values. The interpolation values correspond to a transition from a previous gray level greater than zero to a current gray level. For example, in one embodiment, the interpolation values are based on a minimum gray level of 1 when performing interpolation. That is, the column representing a previous gray level of 0' in table 600 actually represents a previous gray level of 1. As such, when performing interpolation, the interval between columns 615 and 617 is 15.

In one embodiment, bi-linear interpolation is performed to calculate the boosted gray level value for a particular combination of previous gray level and current gray level commands. Bi-linear interpolation requires four entries from the table (e.g., the values from the closest value below and above the previous and current gray levels), in one embodiment. For example if the previous gray level is 94, the major values in the table is found by recognizing that 94 lies between 80 and 96. Similarly, if the current gray level is 165, then 160 and 176 are the next lower and next higher major current gray levels. As shown in FIG. 6, four values are extracted from table 600 to perform bi-linear interpolation. These values are 209 at (80,160); 203 at (96,160); 222 at (80, 176); and 226 at (96, 176). From these four numbers, performing bi-linear interpolation obtains a single number that best approximates the value for the original pairing of 94 for the previous gray level and 165 for the current gray level.

Turning now back to FIG. 6, the remaining N columns 620 comprise the N×N LUT that comprises the second set of interpolation values. That is, the N×N LUT represented by columns 620 provides major values for the boosted gray level between a minimum gray level of 0' (e.g., a value greater than zero) and a maximum gray level for the both the previous and current gray level. As previously described, the maximum gray level in the present embodiment is based on a bit value of 8; however, other embodiments are well suited to maximum gray level values that are based on bit values other than 8.

In addition, the N×N LUT represented by columns 620 corresponds to a second RTC surface providing boosted gray level values when transitioning from a previous gray level that is greater than zero to a first current gray level.

Figure 8:
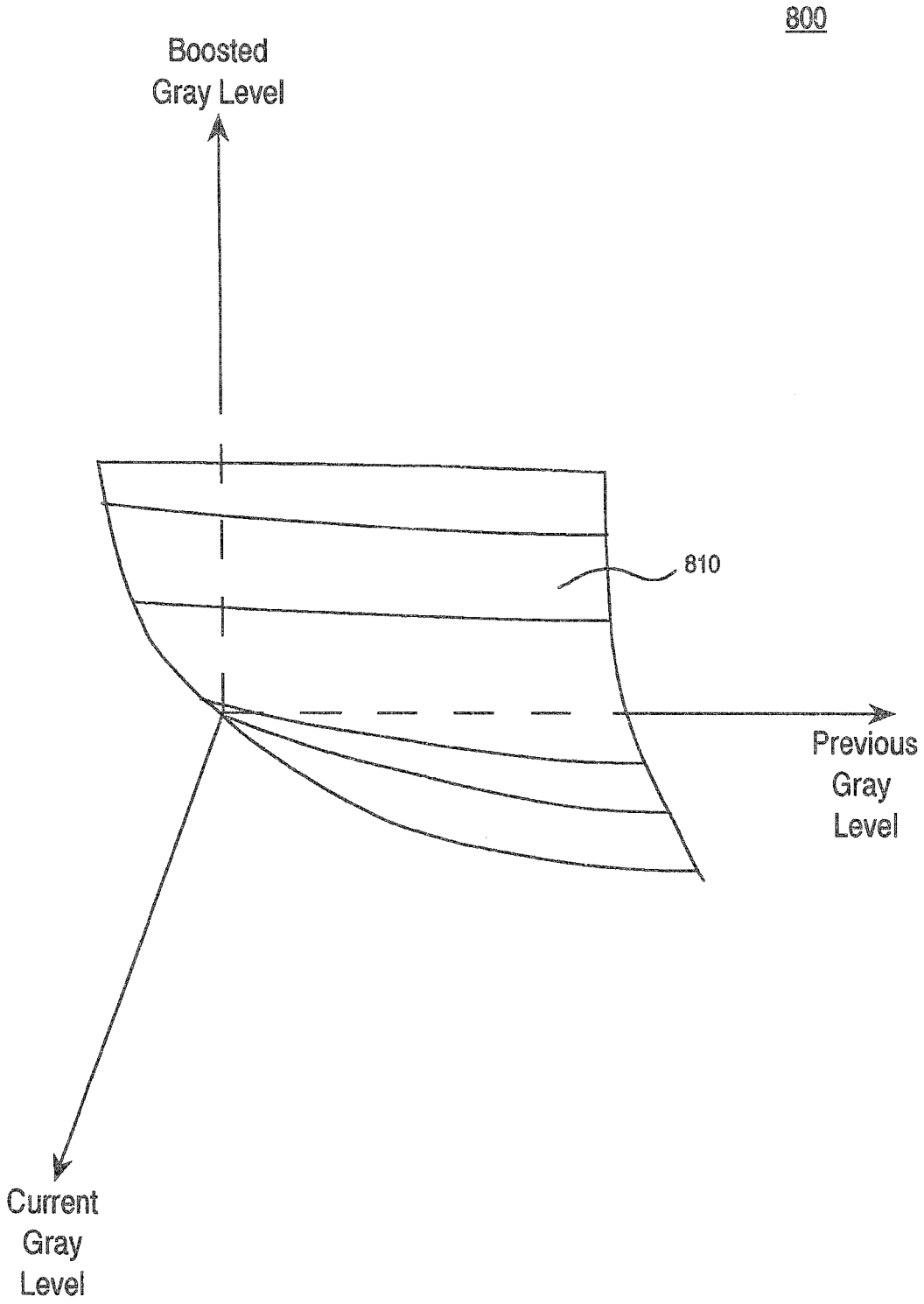
FIG. 8 is a graph illustrating an RTC surface that shows the boosted gray level command values corresponding to a particular combination of a current gray level command and a previous gray level command, in accordance with one embodiment of the present invention.

In one embodiment, FIG. 8 is a graph 800 illustrating the second RTC surface, in accordance with one embodiment of the present invention. As shown in FIG. 8, the second RTC surface 810 shows the boosted gray level command values that correspond to a particular combination of a current gray level command and a previous gray level command. In particular, the second RTC surface is implemented for boosted RTC values when transitioning from a previous gray level greater than zero. In one embodiment, the graph 800 corresponds to the values provided in columns 620 of Table 600.

In one embodiment, Table 600 comprises an N×(N+1) table comprising interpolation values for both the first and second RTC surfaces, as previously described. In another embodiment, two tables are used for performing RTC: the first table comprises a 1×N table comprising a first set of interpolation values used to determine boosted gray level values when transitioning only from a previous gray level of zero to a first current gray level; and a second table comprising an N×N table of entries comprising a second set of interpolation values used to determine boosted gray level values when transitioning from a previous gray level greater than zero to a first current gray level for the color.

Accordingly, various embodiments of the present invention disclose an apparatus and method for enhancing transitions between gray levels for response time compensation. Embodiments of the present invention provide the above accomplishments and further provide for improved handling of transitions from gray level zero using response time compensation.

Embodiments of the present invention, an apparatus and method for performing RTC when transitioning from gray level zero are described. While the invention is described in conjunction with the preferred embodiments, it is understood that they are not intended to limit the invention to these embodiments. On the contrary, the invention is intended to cover alternatives, modifications and equivalents, which may be included within the spirit and scope of the invention as defined by the appended claims. Furthermore, in the detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention.

What is claimed is:

1. An apparatus for performing response time compensation, said apparatus comprising:

a first response time compensation module for providing boosted gray level values when transitioning only from a previous gray level of zero to a first current gray level for a color of a pixel of a display, wherein the boosted gray level values vary with the value of the first current gray level; and a second response time compensation module for providing boosted gray level values when transitioning from a previous gray level greater than zero to said first current gray level for said color of said pixel, wherein a portion of said boosted gray level values provided by said first response time compensation module are substantially greater than a portion of said boosted gray level values provided by said second response time compensation module when said previous gray level greater than zero is less than 16 and differences between said previous gray levels and said current gray levels for said first and second response time compensation modules are approximately equal.

2. The apparatus of claim 1, further comprising:

a 1×N look-up table comprising a first set of interpolation values calculated between a minimum gray level of zero and a maximum gray level for current gray levels, wherein said 1×N look-up table corresponds to a first response time compensation surface providing said boosted gray level values when transitioning only from said previous gray level of zero to said first current gray level.

3. The apparatus of claim 2, further comprising:

an N×N look-up table comprising a second set of interpolation values calculated between a minimum gray level of zero and a maximum gray level for current gray levels and previous gray levels, wherein said N×N look-up table corresponds to an response time compensation surface providing said boosted gray level values when transitioning from a previous gray level greater than zero to a first current gray level for said color.

4. The apparatus of claim 3, wherein said first and second set of interpolation values comprise 8 bit values.

5. The apparatus of claim 2, further comprising:

an N×N look-up table comprising a second set of interpolation values calculated between a minimum gray level greater than zero for previous gray levels and a minimum gray level of zero and said maximum gray level for current gray levels, wherein said N×N look-up table is based on a second response time compensation surface providing said boosted gray level values when transitioning from a previous gray level greater than zero to a first current gray level for said color.

6. The apparatus of claim 5, wherein said minimum gray level greater than zero comprises a value of 1.

7. The apparatus of claim 1, further comprising:

a zero value determination module that determines when said previous gray level is zero.

8. The apparatus of claim 1, further comprising:

an N×(N+1) table comprising interpolation values for said first and second response time compensation surfaces, wherein said N×(N+1) table comprises:

a 1×N table of entries comprising a first set of interpolation values calculated between a minimum gray level of zero and a maximum gray level for current gray levels, wherein said 1×N look-up table corresponds to a first response time compensation surface providing said boosted gray level values when transitioning only from said previous gray level of zero to said first current gray level; and an N×N table of entries comprising a second set of interpolation values calculated between a minimum gray level of zero and a maximum gray level for current gray levels and previous gray levels, wherein said N×N look-up table corresponds to an response time compensation surface providing said boosted gray level values when transitioning from a previous gray level greater than zero to a first current gray level for said color.

9. An apparatus for performing response time compensation, said apparatus comprising:

a 1×N look-up table comprising a first set of interpolation values corresponding to a first response time compensation surface that provides boosted gray level values when transitioning only from a previous gray level of zero to a first current gray level up to a maximum gray level, wherein the boosted gray level values vary with the value of the first current gray level, wherein a portion of said boosted gray level values provided by said first response time compensation surface are substantially greater than a portion of boosted gray level values provided by a second response time compensation surface when transitioning from a previous gray level greater than 0 but less than 16 to said first current gray level, and wherein differences between said previous gray levels and current gray levels for said first and second response time compensation surfaces are approximately equal.

10. The apparatus of claim 9, wherein a boosted gray level value in said first response time compensation surface corresponds to an appropriate luminance of said pixel that approximates said first current gray level within one frame display period.

11. The apparatus of claim 9, further comprising:

an N×N look-up table comprising a second set of interpolation values corresponding to said second response time compensation surface that provides boosted gray level values when transitioning from a previous gray level greater than zero to a second current gray level up to said maximum gray level.

12. The apparatus of claim 11, wherein a boosted gray level value in said second response time compensation surface corresponds to a luminance of a pixel that approximates said second current gray level within one frame display period.

13. The apparatus of claim 11, wherein said maximum gray level is based on an 8 bit value.

14. The apparatus of claim 11, wherein said second set of interpolation values are calculated between a minimum gray level of zero and said maximum gray level for previous gray levels and current gray levels.

15. The apparatus of claim 11, wherein said second set of interpolation values are calculated between a minimum gray level greater than zero and a maximum gray level for previous gray levels and a minimum gray level of zero and said maximum gray level for current gray levels.

16. A method for performing response time compensation, said method comprising:

accessing a previous gray level of a pixel of a display;

accessing a current gray level of a pixel of a display;

determining a first boosted gray level from a first response time compensation surface that provides a first set of boosted gray level values when transitioning only from said previous gray level comprising a first value of zero, wherein the first boosted gray level values vary with the value of the current gray level; and determining a second boosted gray level from a second response time compensation surface that provides a second set of boosted gray level values when transitioning only from said previous gray level comprising a second value greater than zero, wherein a portion of said boosted gray level values provided by said first response time compensation surface are substantially greater than a portion of boosted gray level values provided by the second response time compensation surface when transitioning from a previous gray level greater than 0 but less than 16, and wherein differences between said previous gray levels and current gray levels for said first and second response time compensation surfaces are approximately equal.

17. The method of claim 16, wherein said determining a first boosted gray level further comprises:

determining if said previous gray level comprises a value of zero.

18. The method of claim 16, wherein said determining a first boosted gray level comprises:

performing interpolation on a 1×N look-up table comprising said first response time compensation surface, wherein said 1×N look-up table comprises interpolation values calculated for values between a minimum gray level of zero and a maximum gray level for current gray levels.

19. The method of claim 16, wherein said determining a second boosted gray level comprises:

performing interpolation on an N×N look-up table comprising said second response time compensation surface, wherein said N×N look-up table comprises values between a minimum gray level of zero and a maximum gray level for previous gray levels and current gray levels.

* * * * *